US006784151B2

(12) United States Patent
Capeci et al.

(10) Patent No.: US 6,784,151 B2
(45) **Date of Patent: *Aug. 31, 2004**

(54) PROCESSES FOR MAKING GRANULAR DETERGENT COMPOSITION HAVING IMPROVED APPEARANCE AND SOLUBILITY

(75) Inventors: Scott William Capeci, North Bend, OH (US); Steven Matthew Gabriel, Cincinnati, OH (US); Girish Jagannath, Higashinada-ku (JP); Scott John Donoghue, Jesmond (GB); Christopher Andrew Morrison, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/338,242

(22) Filed: Jan. 8, 2003

(65) Prior Publication Data

US 2003/0134769 A1 Jul. 17, 2003

Related U.S. Application Data

(63) Continuation of application No. 09/830,252, filed as application No. PCT/US99/24686 on Oct. 21, 1999, now Pat. No. 6,555,514.

(60) Provisional application No. 60/105,576, filed on Oct. 26, 1998.

(51) Int. Cl.[7] ..... C11D 11/00

(52) U.S. Cl. ..... 510/444; 510/438; 264/117; 264/140; 23/313 FB

(58) Field of Search ..... 510/444, 438; 264/117, 140; 23/313 FB

(56) References Cited

U.S. PATENT DOCUMENTS

| | | | | | |
|---|---|---|---|---|---|
| 5,733,862 | A | * | 3/1998 | Capeci et al. | 510/444 |
| 6,063,751 | A | * | 5/2000 | France et al. | 510/444 |
| 6,150,323 | A | * | 11/2000 | Del Greco et al. | 510/444 |
| 6,303,558 | B1 | * | 10/2001 | Emery et al. | 510/424 |
| 6,555,514 | B1 | * | 4/2003 | Capeci et al. | 510/444 |

FOREIGN PATENT DOCUMENTS

| | | | | | |
|---|---|---|---|---|---|
| WO | WO 97/28246 | A1 | * | 8/1997 | C11D/17/06 |
| WO | WO 98/14552 | A1 | * | 4/1998 | C11D/11/00 |
| WO | WO 98/14556 | A1 | * | 4/1998 | C11D/11/00 |

* cited by examiner

*Primary Examiner*—Lorna M. Douyon
(74) *Attorney, Agent, or Firm*—Brahm J. Corstanje; Kim William Zerby; Steven W. Miller

(57) ABSTRACT

A multi-step process for making a granular detergent composition. The processing steps include adding to a mixer a first feed stream selected from a first powder, a first liquid, and mixtures thereof, to form a second feed stream. The second feed stream is added to a fluid bed dryer to form the granular detergent composition, and optionally, a third feed stream selected from a second powder, a second liquid, and mixtures thereof can be added to the fluid bed dryer. The granular detergent composition contains at least about 50% by weight of particles having a geometric mean particle diameter of from about 500 microns to about 1500 microns with a geometric standard deviation of from about 1 to about 2. Further, at least a portion of the particles contain a detersive surfactant or a detergent builder.

1 Claim, No Drawings

PROCESSES FOR MAKING GRANULAR DETERGENT COMPOSITION HAVING IMPROVED APPEARANCE AND SOLUBILITY

CROSS REFERENCE TO RELATED APPLICATION

This application is a continuation of U.S. application Ser, No. 09/830,252, filed Apr. 24, 2001, now U.S. Pat. No. 6,555,514, which is a 371 of International Application PCT/US99/24686 filed Oct. 21, 1999 which claims the benefit of U.S. Provisional Application No. 60/105,576 filed Oct. 26, 1998, said applications and patent being incorporated herein by reference.

FIELD OF THE INVENTION

The present invention relates to an improved process for making granular detergent compositions which have superior solubility, especially in cold temperature laundering solutions (i.e., less than about 30° C.), excellent flow properties (even after storage), and aesthetics/appearance. More particularly, the present process results in detergent compositions containing optimal levels of particles having optimally selected particle size and particle size distribution for achieving the desired improvements.

BACKGROUND OF THE INVENTION

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility, flowability after standard storage conditions and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case, the undesired result is undissolved detergent residue in the dispensing device.

It has been found that the cause of the aforementioned dissolution problem is associated at least in part with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a highly viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a process for making detergent compositions having improved dissolution without significantly inhibiting formulation flexibility.

Accordingly, despite the disclosures in the prior art discussed previously, it would be desirable to have a process for making a granular detergent composition which exhibits improved solubility, is more aesthetically pleasing to consumers, has improved flowability and exhibits improved cleaning performance. Also, it would be desirable to have such a process having substantial process flexibility yet still resulting in a detergent composition which exhibits improved dissolution without significantly inhibiting formulation flexibility.

SUMMARY OF THE INVENTION

The invention meets the needs above by providing a process for making a detergent composition which has improved solubility or dissolution in laundering solutions, especially in solutions kept at cold temperatures (i.e., less than about 30° C.), is aesthetically pleasing to consumers and has improved flowability. The process for making the granular detergent compositions has substantial flexibility yet results in an optimally selected level of particles having a judiciously selected geometric mean particle diameter with a selected geometric standard deviation.

In accordance with one aspect of the invention, there is provided a process for making a granular detergent composition comprising the steps of:

a) adding to a mixer a first feed stream comprising a component selected from the group consisting of a first powder, a first liquid, and mixtures thereof, to form a second feed stream;

b) adding the second feed stream to a fluid bed dryer to form the granular detergent composition;

c) optionally, adding to the fluid bed dryer a third feed stream comprising a component selected from the group consisting of a second powder, a second liquid, and mixtures thereof; and wherein the resulting granular detergent composition comprises at least about 50%, preferably 75%, and most preferably 90%, by weight of particles having a geometric mean particle diameter of from about 500 microns to about 1500 microns, preferably the geometric mean particle diameter of the particles are from about 600 microns to about 1200 microns, and most preferably, from about 700 microns to about 1000 microns, with a geometric standard deviation of from about 1 to about 2, preferably from about 1.0 to 1.7, and more preferably from about 1.0 to about 1.4, wherein at least a portion of the particles contain a detersive surfactant or a detergent builder. Preferably the first powder and the second powder each comprise a material selected from the group consisting of surfactants, inorganic salts, bleaches, bleach activators, builders, enzymes, encapsulated perfumes, and mixtures thereof, and the first liquid and the second liquid each comprise a material selected from the group consisting of water, surfactants, inorganic salts, dyes, polymers, builders, binders, perfumes, and mixtures thereof. Most preferably the added liquids comprise detergent surfactants in an aqueous paste form.

The invention also provides a method of laundering soiled fabrics comprising the step of contacting the soiled fabrics with an aqueous solution containing an effective amount of a detergent composition made according to the invention described herein.

Accordingly, it is an advantage of the invention to provide a process for making granular detergent compositions which exhibit improved solubility, are more aesthetically pleasing to consumers, have improved flowability and exhibit improved cleaning performance. It is also an advantage to have such a detergent composition which exhibits such improved dissolution without significantly inhibiting formulation flexibility.

DETAILED DESCRIPTION OF THE INVENTION

Definitions

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Marcel Dekker 1997.

As used herein, the phrase "builder" means any organic or inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

As used herein, "composition" and "granular detergent composition" are intended to include both final products and additives/components of a detergent composition. That is, the compositions produced by the processes claimed herein may be complete laundry detergent compositions or they may be additives that are used along with other detergent ingredients for laundering fabrics and the like.

Detergent Making Process

There are multiple variations on the process for making a granular detergent composition defined in the Summary of the Invention above. Two such processes are given below. Specifically, one process according to this invention, for making a granular detergent composition comprises the steps of:

a) adding to a first fluid bed dryer a first feed stream comprising a component selected from the group consisting of a first powder, a first liquid, and mixtures thereof, to form a second feed stream;

b) adding the second feed stream to a mixer, to form a fourth feed stream;

c) optionally, adding to the mixer a third feed stream comprising a component selected from the group consisting of a second powder, a second liquid, and mixtures thereof;

d) adding to a second fluid bed dryer the fourth feed stream to form the granular detergent composition;

e) optionally, adding a portion of the second feed stream to the second fluid bed dryer by-passing the mixer.

Wherein the granular detergent composition comprises at least about 50% by weight of particles having a geometric mean particle diameter of from about 500 microns to about 1500 microns with a geometric standard deviation of from about 1 to about 2, preferably from about 1.0 to 1.7, more preferably from about 1.0 to about 1.4, wherein at least a portion of the particles contain a detersive surfactant or a detergent builder. In this process the second fluid bed dryer is preferably adjacent the first fluid bed dryer.

Another process according to this invention, for making a granular detergent composition comprises the steps of:

a) adding to a fluid bed dryer a first feed stream comprising a component selected from the group consisting of a first powder, a first liquid, and mixtures thereof, to form a second feed stream;

b) adding to a mixer a third feed stream comprising a component selected from the group consisting of a second powder, a second liquid, and mixtures thereof, to form a fourth feed stream;

c) combining the second feed stream with the fourth feed stream to form the granular detergent composition.

Wherein the granular detergent composition comprises at least about 50% by weight of particles having a geometric mean particle diameter of from about 500 microns to about 1500 microns with a geometric standard deviation of from about 1 to about 2, wherein at least a portion of the particles contain a detersive surfactant or a detergent builder. Preferably the geometric standard deviation is from about 1.0 to about 1.7, preferably from about 1.0 to about 1.4.

The granular detergent composition resulting from the processes may comprise fine particles, wherein "fine particles" are defined as particles that have a geometric mean particle diameter that is less than about 1.65 standard deviations below the chosen geometric mean particle diameter of the granular detergent composition. Large particles may also exist wherein "large particles" are defined as particles that have a geometric mean particle diameter that is greater than about 1.65 standard deviations above the chosen geometric mean particle diameter of the granular detergent composition. The fine particles are preferably separated from the granular detergent composition and returned to the process by adding them to at least one of the mixer and the fluid bed dryer. Likewise, the large particles are preferably separated from the granular detergent composition and then fed to a grinder where their geometric mean particle diameter is reduced. After the geometric mean particle diameter of the large particles is reduced, the large particles are returned to the process by adding them to at least one of the mixer and the fluid bed dryer.

Optionally, at least one of the first feed stream, the first powder stream and the second powder stream can be processed to remove particles having geometric mean particle diameter of from about 500 microns to about 1500 microns with a geometric standard deviation of from about 1 to about 2. These "in-spec" particles can be fed directly to the resulting granular detergent composition. The processing of the feed streams can be accomplished by, for example "screening", to remove the particles that have the desired geometric mean particle diameter. Screening, and other methods of particle separation are well known to those skilled in the art. By feeding these "in-spec" particles directly to the resulting granular detergent composition, the granular detergent making process is by-passed. This reduces the load on the granular detergent making equipment and increases the yield of particles within the desired size range.

The resulting detergent particles produced according to the process of this invention are "crisp" agglomerates as they are commonly referred to by those skilled in the art. Furthermore, the powdered material can, and preferably does, add alkalinity to the detergent mixture, a condition necessary for optimum cleaning performance.

As discussed above, in one step of the present process, the detergent particles are conditioned by drying. Dryers that are suitable for use in the present will be known to those skilled in the art. Examples of dryer characteristics include fixed or vibrating; rectangular bed or round bed; and straight or serpentine dryers. Manufacturers of such dryers include Niro, Bepex, Spray Systems and Glatt. By way of example, apparatus such as a fluidized bed can be used for drying while an airlift can be used for cooling should it be necessary. The air lift can also be used to force out the "fine" particles so that they can be recycled to the particle agglomeration process.

Preferably the fluid bed dryer has multiple internal "stages" or "zones". A stage or zone is any discrete area within the dryer, and these terms are used interchangeably herein. The process conditions within a stage may be different or similar to the other stages in the dryer. It is understood that two adjacent dryers are equivalent to a single dryer having multiple stages. The various feed streams can be added at the different stages, depending on, for example, the particle size and moisture level of the feed stream. Feeding different streams to different stages can minimize the heat load on the dryer, and optimize the particle size and shape as defined herein. Liquids are added to a dryer through nozzles above or within the product flowing through the dryer, and the nozzles can spray upward, across or downward depending on their position within the dryer.

In another step of the present invention the particles can be processed in a mixer that can be a low, moderate or high speed. The particular mixer used in the present process should include pulverizing or grinding and agglomeration tools so that both techniques can be carried forth simultaneously in a single mixer. To that end, it has been found that the first processing step can be successfully completed, under the process parameters described herein, in a Lodige KM™ (Ploughshare) 600 moderate speed mixer, Lodige CB™ high speed mixer, or mixers made by Fukae, Drais, Schugi or similar brand mixer. The Lodige KM™ (Ploughshare) 600 moderate speed mixer, which is a preferred mixer for use in the present invention, comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer.

Preferably, the mean residence time of the various starting detergent ingredients in the low, moderate or high speed mixer is preferably in range from about 0.1 minutes to about 15 minutes, most preferably the residence time is about 0.5 to about 5 minutes. In this way, the density of the resulting detergent agglomerates is at the desired level.

The processes of this invention can comprise the step of spraying an additional binder in the mixer to facilitate production of the desired detergent particles. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

The particles of this invention can be further processed by adding a coating agent to improve the particle color, increase the particle "whiteness", or improve the particle flowability after they exit the mixer or the dryer to obtain the high density granular detergent composition produced by the processes of this invention. Those skilled in the art will appreciate that a wide variety of methods may be used to dry as well as cool the exiting detergent particles without departing from the scope of the invention. Since the mixer can be operated at relatively low temperatures, the need for cooling apparatus is not required by the present process, which thereby further reduces manufacturing costs of the final product.

Another optional processing step includes continuously adding a coating agent such as zeolites and fumed silica to the mixer to facilitate free flowability of the resulting detergent particles and to prevent over agglomeration. In addition, the detergent starting materials can be fed into a pre-mixer, such as a Lodige CB mixer or a twin-screw extruder, prior to entering in the mixer described herein. This step, although optional, does indeed facilitate agglomeration.

Physical Properties

The granular detergent composition achieves the desired benefits of solubility, improved aesthetics and flowability via optimal selection of the geometric mean particle diameter of certain levels of particles in the composition. By "improved aesthetics", it is meant that the consumer prefers a granular detergent product which has a more uniform appearance of particles as opposed to past granular detergent products which contained particles of varying size and composition. To that end, at least about 50%, more preferably at least about 75%, even more preferably at least about 90%, and most preferably at least about 95%, by weight of the total particles in the detergent product, have the selected mean particle size diameter. In this way, a substantial portion of the granular detergent product will have the uniform size so as to provide the aesthetic appearance desired by consumers.

Preferably, the geometric mean particle diameter of the particles is from about 500 microns to about 1500 microns, more preferably from about 600 microns to about 1200 microns, and most preferably from about 700 microns to about 1000 microns. The particle size distribution is defined by a relative tight geometric standard deviation or "span" so as not to have too many particles outside of the target size. Accordingly, the geometric standard deviation is preferably is from about 1 to about 2, more preferably is from about 1.0 to about 1.7, even more preferably is from about 1.0 to about 1.4, and most preferably is from about 1.0 to about 1.2.

While not intending to be bound by theory, it is believed that solubility is enhanced as a result of the particles in the detergent composition being more of the same size. Specifically, as a result of the particles being more uniform in size, the actual "contact points" among the particles in the detergent composition is reduced which, in turn, reduces the "bridging effect" commonly associated with the "lump-gel" dissolution difficulties of granular detergent compositions. Previous granular detergent compositions contained particles of varying sizes which leads to more contact points among the particles. For example, a large particle could have many smaller particles in contact with it rendering the particle site ripe for lump-gel formation. The level and uniform size of the particles in the granular detergent composition of the present invention avoids such problems.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will contain from about 1% to about 50% by weight of a detersive surfactant and from about 1% to about 75% by weight of a detergent builder.

A particularly important attribute of detergent powders is color. Color is usually measured on a Hunter Colorimeter and reported as three parameters "L", "a" and "b". Of particular relevance to the powdered detergent consumer is the whiteness of the powder determined by the equation L-3b. In general, whiteness values below about 60% are considered poor. Whiteness can be improved by a number of means known to those of ordinary skill in the art. For example, coating granules with Titanium Dioxide.

In addition to the average whiteness of the bulk product, it is also important to have uniformity of color. Having a high percentage of particles of substantially different color can either skew the overall impression of the product (to appear more like the poorer colored granule) or at lower levels, make the product appear speckled. But it is understood that components present at very low levels, that is less than about 1% by weight, do not make any significant contribution to the overall appearance of the product. Color uniformity can be assessed two ways:

1. the difference between the highest (maximum) and lowest (minimum) whiteness; and
2. a UNIFORMITY parameter, which is the maximum value of the following equation applied to all components in excess of 1% of the composition:

$$\text{UNIFORMITY}=(1/\text{wt}\%x)*\text{Abs}(\text{whiteness}x-\text{bulkwhiteness})$$

wherein:

component x is a portion of the detergent composition that has a different level of whiteness compared-to the bulk detergent;

whitenessx=the whiteness level of component x as measured on a Hunter Colorimeter;

bulkwhiteness2=the whiteness level of the bulk detergent as measured on a Hunter Colorimeter;

wt %x=the weight percent of component x;

Abs=the absolute value; and

Preferably the granular detergents of this invention have whitenesses of 60–100, preferably 75–100, more preferably, 85–100 and most preferably, 92–100. Also preferred are granular detergents where all components have a whiteness difference (maximum−minimum) of less than about 40, preferably less than 30, more preferably less than 20 and most preferably less than 10. The Granular detergents of this invention preferably have UNIFORMITY, as defined above, of less than about 200, more preferably less than about 100, most preferably less than about 50 and most preferably less than about 25.

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. And the combination of the two parameters as defined by the product of the parameters is important as well (i.e. both must be controlled to get a product with good appearance). Preferably, the granular detergent compositions of this invention have circularities less than about 50, preferably less than about 30, more preferably less than about 23, most preferably less than about 18. Also preferred are granular detergent compositions with aspect ratios less than about 2, preferably less than about 1.5, more preferably less than about 1.3 most preferably less than about 1.2.

Additionally, it is preferred to have a uniform distribution of shapes among the particles in the composition.

Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

The preferred detergent compositions of this invention meet at least one and/most preferably all, of the attribute measurements and standard deviations as defined above, that is for whiteness, color uniformity circularity and aspect ratio.

Detergent Components

The surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

EXAMPLES

The following examples are presented for illustrative purposes only and are not to be construed as limiting the scope of the appended claims in any way.

Example I

This Example illustrates a process according to this invention which produces uniform free flowing, crisp, high density detergent particles of the desired size. Several feed streams of various detergent starting ingredients are continuously fed, at a rate of 660 kg/hr, into a Lodige KM™ (Ploughshare) 600 mixer, which is a horizontally-positioned moderate speed mixer. The rotational speed of the shaft in the mixer is about 100 rpm and the rotational speed of the cutters is about 3600 rpm. The relative proportion of each starting detergent ingredient in the total feed stream fed into the mixer (the phrase "total feed stream" meaning the aggregate of all the individual feed streams being fed into the mixer) is presented in Table I below:

TABLE I

| Component | % Weight of Total Feed |
|---|---|
| $C_{45}$ alkyl ethoxylate sulfate (EO 0.6) | 29.1 |
| Aluminosilicate | 34.4 |
| Sodium carbonate | 17.5 |
| Polyethylene glycol (MW 4000) | 1.3 |
| Misc. (water, perfume, etc.) | 16.7 |
| | 100.0 |

While the starting detergent ingredients are continuously passed into a Lodige KM™ (Ploughshare) 600 mixer, their mean residence time in the mixer is about 2–3 minutes. A water binder is continuously fed into the Lodige KM™ 600 mixer to aid in the agglomeration process. The agglomerates from the mixer are dried in a conventional fluidized bed dryer after they exit the Lodige KM™ 600 mixer to obtain the high density granular detergent agglomerates produced by the process. The density of the resulting detergent agglomerates is 796 g/l and the mean particle size is 613 microns.

Example II

This Example also illustrates the process of the invention and incorporates the parameters of Example 1. Accordingly, several feed streams of various detergent starting ingredients are continuously fed, at a rate of 660 kg/hr, into a Lodige KM™ (Ploughshare) 600 mixer, which is a horizontally-positioned moderate speed mixer. The rotational speed of the shaft in the mixer is about 100 rpm and the rotational speed of the cutters is about 3600 rpm. The relative proportion of each starting detergent ingredient in the total feed stream fed into the mixer is presented in Table II below:

TABLE II

| Component | % Weight of Total Feed |
|---|---|
| $C_{45}$ alkyl ethoxylate sulfate (EO 0.6) | 29.1 |
| Aluminosilicate | 45.0 |
| Sodium carbonate | 15.1 |
| Polyethylene glycol (MW 4000) | 1.3 |
| Misc. (water, perfume, etc.) | 9.5 |
| | 100.0 |

While the starting detergent ingredients are continuously passed into a Lodige KM™ (Ploughshare) 600 mixer, their mean residence time in the mixer is about 2–3 minutes. A water binder is continuously fed into the Lodige KM™ 600 mixer to aid in the agglomeration process. The agglomerates from the mixer are dried in a conventional fluidized bed dryer after they exit the Lodige KM™ 600 mixer to obtain the high density granular detergent agglomerates produced by the process. The density of the resulting detergent agglomerates is 700 g/l and a mean particle size of 550 microns.

Example III

The following are examples of granular detergent compositions according to this invention. Specifically, in all Example III compositions the compositions were prepared by feeding the spraydried particles, agglomerates and builder agglomerates first into a Lodige KM™ 600 mixer at 660 kg, with the drum rotation at 100 RPM and cutter speed at 3600 RPM. The resulkting mixture was fed into a fluid bed dryer. An aqueous solution of PEG-400 (35% by weight solids) was sprayed onto the mixture in the first of three stages in the fluid bed dryer. The resulting product was screened to collect the particles in the range of about 600 to about 1100$\mu$. The fines were recycled to the Lodige KM and the large particles were ground and recycled to the fluid bed dryer.

The compositions exemplified below have at least 90% by weight of particles having a geometric mean particle diameter of about 800 microns with a geometric standard deviation of from about 1.2. Unexpectedly, the compositions have improved aesthetics, flowability and solubility.

Abbreviations Used in the Granular Detergent Composition Examples

In the detergent compositions, the abbreviated component identifications have the following meanings:

| | |
|---|---|
| LAS | Sodium linear C11–13 alkyl benzene sulfonate |
| TAS | Sodium tallow alkyl sulfate |
| CxyAS | Sodium Clx–Cly alkyl sulfate |
| C46SAS | Sodium C14–C16 secondary (2,3) alkyl sulfate |
| CxyEzS | Sodium Cx–Cy alkyl sulfate condensed with z moles of ethylene oxide |
| CxyEz | Clx–Cly predominantly linear primary alcohol condensed with an average of z moles of ethylene oxide |
| QAS | R2.N+(CH3)2(C2H4OH) with R2 = C12–C14 |
| QAS 1 | R2.N+(CH3)2(C2H4OH) with R2 = C8–C11 |
| APA | C8–C10 amido propyl dimethyl amine |
| Soap | Sodium linear alkyl carboxylate derived from an 80/20 mixture of tallow and coconut fatty acids |
| STS | Sodium toluene sulphonate |
| CFAA | C12–C14 (coco) alkyl N-methyl glucamide |
| TFAA | C16–C18 alkyl N-methyl glucamide |
| TPKFA | C12–C14 topped whole cut fatty acids |
| STPP | Anhydrous sodium tripolyphosphate |
| TSPP | Tetrasodium pyrophosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula δ-Na2Si2O5 |
| Citric Acid | Anhydrous citric acid |
| Borate | Sodium borate |
| Carbonate | Anhydrous sodium carbonate with a particle size between 200 μm and 900 μm |
| Bicarbonate | Anhydrous sodium bicarbonate with a particle size between 400 μm and 1200 μm |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight of 70,000 |
| MA/AA(1) | Copolymer of 4:6 maleic/acrylic acid, average molecular weight of 10,000 |
| AA | Sodium polyacrylic polymer of average molecular weight 4,500 |
| CMC | Sodium carboxymethyl cellulose |
| Cellulose ether | Methyl cellulose ether with a degree of polymerization of 650 available from Shin Etsu Chemicals. |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |

-continued

| | |
|---|---|
| Lipase (I) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula NaBO2.3H2 O.H2O2- |
| PB1 | Anhydrous sodium perborate bleach of nominal formula NaBO2.H 2O2 |
| Percarbonate | Sodium percarbonate of nominal formula 2Na2CO3.3H2O2 |
| NOBS | Nonanoyloxybenzene sulfonate in the form of sodium salt |
| NAC-OBS | (6-nonamidocaproyl) oxybenzene sulfonate |
| TAED | Tetraacetylethylenediamine |
| DTPA | Diethylene triamine pentaacetic acid |
| DTPMP | Diethylene triamine penta (methylene phosphate), marketed by Monsanto under the Tradename Dequest 2060 |
| EDDS | Ethylenediamine-N,N'-disuccinic acid, (S,S) isomer in the form of its sodium salt. |
| Photoactivated | Sulfonated zinc phthlocyanine encapsulated in bleach (1) dextrin soluble polymer |
| Photoactivated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl-)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PV1 | Polyvinyl imidisole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPV1 | Copolymer of polyvinylpyrolidone and vinylimidazole, with an average molecular weight of 20,000 |
| QEA | bis((C2H5O)(C2H4O)n)(CH3)-N+-C6H12-N+-(CH3) bis(C2H5O)-(C2H4 O))n wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam comtroller to said dispersing agent of 10:1 to 100:1 |
| Opacifier | Water based monostyrene latex mixture, sold by BASF Aktiengesellschaft under the tradename Lytron 621 |
| Wax | Parrafin wax |

In the following examples all levels are quoted as % by weight of the composition:

TABLE III A

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |

TABLE III A-continued

The following compositions are in accordance with the invention.

| | A | B | C | D | E | F | G | H | I |
|---|---|---|---|---|---|---|---|---|---|
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate (40:20:40) | 8.0 | 10.0 | 10.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | 1.2 |
| Citric acid | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE III B

The following compositions are in accordance with the invention.

| | A | B | C | D | E | F | G | H | I |
|---|---|---|---|---|---|---|---|---|---|
| Spray-Dried Granules | | | | | | | | | |
| LAS | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | — |
| TPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| $AE_3$ | — | — | — | — | — | — | — | 1.0 | 0.5 |
| Carbonate | — | — | — | — | 4.0 | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/ carbonate/bicarbonate (40:20:40) | 8.0 | 10.0 | 4.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | 4.0 | — | 3.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |

TABLE III B-continued

The following compositions are in accordance with the invention.

| | A | B | C | D | E | F | G | H | I |
|---|---|---|---|---|---|---|---|---|---|
| Dyed carbonate (blue, green) | 0.5 | 0.5 | ? | 3.0 | — | 0.5 | 0.5 | 0.5 | 1.0 |
| SKS-6 | — | — | — | 4.0 | — | — | — | 6.0 | — |
| Fillers up to 100% | | | | | | | | | |

Having thus described the invention in detail, it will be obvious to those skilled in the art that various changes may be made without departing from the scope of the invention and the invention is not to be considered limited to what is described in the specification.

What is claimed is:

1. In a process for making a granular detergent composition comprising the steps of:

a) adding to a first fluid bed dryer a first feed stream comprising a component selected from the group consisting of a first powder, a first liquid, and mixtures thereof, to form a second feed stream;

b) adding the second feed stream to a mixer, to form a fourth feed stream;

c) optionally, adding to the mixer a third feed stream comprising a component selected from the group consisting of a second powder, a second liquid, and mixtures thereof;

d) adding to a second fluid bed dryer the fourth feed stream to form the granular detergent composition;

e) optionally, adding a portion of the second feed stream to the second fluid bed dryer by-passing the mixer; and wherein the granular detergent composition comprises at least about 50% by weight of particles having a geometric mean particle diameter of from about 500 microns to about 1500 microns with a geometric standard deviation of from about 1 to about 2, wherein at least a portion of the particles contain a detersive surfactant or a detergent builder, the improvement which comprises screening said first powder or said second powder, or both, to remove particles having a geometric particle diameter of from about 500 microns to about 1500 microns with a geometric standard deviation of from about 1 to about 2 and feeding said particles directly to the resulting granular detergent composition.

* * * * *